US008253671B2

(12) United States Patent
Kim et al.

(10) Patent No.: US 8,253,671 B2
(45) **Date of Patent: *Aug. 28, 2012**

(54) LIQUID CRYSTAL DISPLAY FOR IMPROVING DYNAMIC CONTRAST AND A METHOD FOR GENERATING GAMMA VOLTAGES FOR THE LIQUID CRYSTAL DISPLAY

(75) Inventors: Jong-Seon Kim, Pyeongtaek (KR); Man-Bok Cheon, Yongin (KR); Seung-Woo Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 1336 days.

This patent is subject to a terminal disclaimer.

(21) Appl. No.: 11/933,355

(22) Filed: Oct. 31, 2007

(65) Prior Publication Data

US 2008/0278430 A1 Nov. 13, 2008

Related U.S. Application Data

(63) Continuation of application No. 10/385,249, filed on Mar. 10, 2003, now Pat. No. 7,317,460.

(30) Foreign Application Priority Data

Mar. 11, 2002 (KR) ..... 10-2002-0012937

(51) Int. Cl.
*G09G 3/36* (2006.01)

(52) U.S. Cl. ..... 345/89; 345/690; 345/88; 345/204

(58) Field of Classification Search ..... 345/88, 345/89, 94, 95, 690, 204; 348/254, 674
See application file for complete search history.

(56) References Cited

U.S. PATENT DOCUMENTS 4,489,349 A * 12/1984 Okada ..... 348/674
5,546,134 A * 8/1996 Lee ..... 348/673
5,929,417 A 7/1999 Hayashi et al.
5,949,496 A * 9/1999 Kim ..... 348/645
6,335,716 B1 * 1/2002 Yamazaki et al. ..... 345/92
6,462,735 B2 10/2002 Naito
6,654,028 B1 * 11/2003 Yamakawa ..... 345/690
(Continued)

FOREIGN PATENT DOCUMENTS

JP 03-251818 11/1991
(Continued)

*Primary Examiner* — Lun-Yi Lao
*Assistant Examiner* — Tom V Sheng
(74) *Attorney, Agent, or Firm* — Cantor Colburn LLP

(57) ABSTRACT

An LCD for improving dynamic contrast by adjusting gamma voltages according to the brightness of an image is provided. The LCD includes: a liquid crystal display panel assembly having a plurality of pixels provided on crossing areas of a plurality of gate lines and a plurality of data lines; a gate driver applying voltage signals for sequentially scanning the gate lines; a source driver applying voltage signals for image display to the data lines; a timing controller providing image data and a control signal for the source driver, providing a gate line on/off control signal for the gate driver, and outputting digital gamma data to a digital/analogue (D/A) converter; and the D/A converter connected to the timing controller for converting the digital gamma data from the timing controller into analog signals to generate a plurality of gamma voltages and outputting the gamma voltages to the source driver. The LCD generates the gamma voltages by the D/A converter in place of using serially-connected resistors, and thus, the gamma voltages may vary depending on the brightness of the image.

20 Claims, 5 Drawing Sheets

U.S. PATENT DOCUMENTS

| | | | | |
|---|---|---|---|---|
| 6,731,259 | B2 | 5/2004 | Yer et al. | |
| 6,747,708 | B2 * | 6/2004 | Taniai et al. | 348/761 |
| 6,778,182 | B2 | 8/2004 | Yamakawa | |
| 6,806,861 | B1 | 10/2004 | Sakaguchi et al. | |
| 7,227,559 | B2 * | 6/2007 | Aoki et al. | 345/690 |
| 7,317,460 | B2 * | 1/2008 | Kim et al. | 345/690 |
| 2002/0063666 | A1 | 5/2002 | Kang et al. | |
| 2003/0067435 | A1 | 4/2003 | Liu | |

FOREIGN PATENT DOCUMENTS

| | | |
|---|---|---|
| JP | 06006820 | 1/1994 |
| JP | 08251515 | 9/1996 |
| JP | 08278486 | 10/1996 |
| JP | 10333648 | 12/1998 |
| JP | 11327496 | 11/1999 |
| JP | 2000-029435 | 1/2000 |
| JP | 2001195031 | 7/2001 |
| JP | 2001-255853 | 9/2001 |
| JP | 2001-350450 | 12/2001 |
| JP | 2001346219 | 12/2001 |
| KR | 1020020001466 | 1/2002 |

* cited by examiner

LIQUID CRYSTAL DISPLAY FOR IMPROVING DYNAMIC CONTRAST AND A METHOD FOR GENERATING GAMMA VOLTAGES FOR THE LIQUID CRYSTAL DISPLAY

CROSS REFERENCE TO RELATED APPLICATIONS

This application is a continuation application of U.S. application Ser. No. 10/385,249 filed Mar. 10, 2003, which claims priority to and the benefit of Korean Patent Application No. 2002-0012937, filed on Mar. 11, 2002, all of which are incorporated herein in their entirety.

BACKGROUND OF THE INVENTION (a) Field of the Invention

The present invention relates to a liquid crystal display ("LCD") and a method of generating gamma voltages for an LCD and, in particular, to an LCD and a method of generating gamma voltages for an LCD for improving dynamic contrast of an image of an LCD by adjusting gamma voltages based on the brightness of an image.

(b) Description of the Related Art

Recently, as personal computers and television sets are lighter and slimmer, flat panel displays such as liquid crystal displays ("LCD") have been developed and put into practice in various fields to replace cathode-ray tubes ("CRTs").

LCDs display images by adjusting an electric field applied to liquid crystal material with dielectric anisotropy interposed between two panels, thereby controlling the transmittance of light passing through the panels.

LCDs have been used in notebook computers and desktop monitors. The users of computers have a desire to see motion pictures using display devices of the computers under improved multimedia circumstances. However, the currently used LCDs are inferior to the CRTs in dynamic contrast. Accordingly, in order to apply the LCDs for television sets, it is required to further improve the dynamic contrast of the LCDs.

Now, a typical LCD is described with reference to FIG. 1.

FIG. 1 shows an entire configuration of a conventional LCD.

As shown in FIG. 1, a conventional LCD includes an LCD panel assembly 1 having a plurality of pixels provided at the intersections of a plurality of gate lines and a plurality of data lines, a plurality of gate driving integrated circuits ("ICs") 2 applying voltage signals for sequentially scanning the gate lines, a plurality of source driving ICs 3 applying voltage signals for image display to the data lines, a gamma voltage generator 5 having a plurality of resistors connected in series for generating a plurality of gamma voltages, a plurality of analog buffers 6 and 7 for providing the generated gamma voltages to the source driving ICs 3, and a timing controller 4 for performing gate on/off control as well as providing image data and other control signals for the source driving ICs 3.

In the above described LCD, the gate driving ICs 2 sequentially turn on the gate lines of the LCD panel assembly 1 under the gate on/off control of the ming controller 4. The source driving ICs 3 convert the image data from the timing controller 4 into voltage signals and then write the voltage signals to the pixels associated with the turned-on gate lines, on the basis of the control signals. The desired images are displayed in this manner.

A voltage signal for image display is generated by selecting appropriate one among the gamma voltages, which are provided by the gamma voltage generator 5 via the analog buffers 6 and 7, corresponding to the image data from the timing controller 4. That is, the source driving ICs 3 select the voltage signals to be applied to the LCD panel assembly 1 among the gamma voltages generated by the voltage division of the resistors of the gamma voltage generator 5.

However, the gamma voltages of a conventional LCD are fixed by the serially-connected resistors such that the brightness of an image implemented by these gamma voltages is also unchangeable. In other words, the fixed gamma voltages of the conventional LCD do not adjust the brightness of an image which is required when the image is brighter or darker.

SUMMARY OF THE INVENTION

The present invention has been made in an effort to solve the above problems.

The present invention provides an LCD and a method of generating a plurality of gamma voltages for an LCD, which are capable of improving the dynamic contrast of an image by displaying the image on the basis of gamma voltages generated by converting digital gamma data for gamma voltages into analog signals, for adjusting the brightness of the image.

According to one aspect of the present invention, an LCD includes: a liquid crystal display panel assembly having a plurality of pixels provided on crossing areas of a plurality of gate lines and a plurality of data lines; a gate driver applying voltage signals for sequentially scanning the gate lines; a source driver applying voltage signals for image display to the data lines; a timing controller providing image data and a control signal for the source driver, providing a gate line on/off control signal for the gate driver, and outputting digital gamma data to a digital/analogue (D/A) converter during a blank duration; the D/A converter connected to the timing controller, the D/A converter converting the digital gamma data from the timing controller into analog signals to generate a plurality of gamma voltages and outputting the gamma voltages to the source driver. The timing controller may comprise a memory for storing the digital gamma data. The D/A converter may be connected to the timing controller via a digital interface.

According to another aspect of the present invention, a method of generating a gamma voltage for a liquid crystal display comprises receiving red, green, and blue data from a graphic source; calculating an average brightness of the red, green, and blue data for a frame; determining a brightness of an image of the frame based on the average brightness; selecting and transmitting digital gamma data suitable for the image brightness of the frame; and converting the selected digital gamma data into an analog signal to generate a gamma voltage.

According to further aspect of the present invention, a method for generating a gamma voltage for a liquid crystal display, comprises receiving image data from a graphic source; calculating an average brightness of the image data for a current frame; determining a brightness of the frame based on the average brightness of the frame; adjusting digital gamma data for the current frame based on the average brightness of the current frame; and generating a gamma voltage for the current frame in response to the adjusted digital gamma data.

According to the present invention, the gamma voltages are generated by converting the digital gamma data from the timing controller into analog signals by the D/A converter in place of using serially-connected resistors.

A conventional technique using the serially-connected resistors gives a characteristic curve of gamma voltages fixed by the resistances of the resistors. On the contrary, the gamma voltages according to the present invention may vary depending on the brightness of the image. For example, the gamma voltages are adjusted for obtaining high dynamic contrast such that the characteristic curve of the gamma curve is lowered for a dark image and is raised for a bright image. The D/A converter according to the present invention generates the gamma voltages which are adjustable based on the brightness of the image.

DETAILED DESCRIPTION OF PREFERRED EMBODIMENTS

Preferred embodiments of the present invention will be described in detail hereinafter with reference to the accompanying drawings.

An LCD and a gamma voltage generating method therefor according to a first embodiment of the present invention are described with reference to FIGS. 2 to 4.

Figure 1:
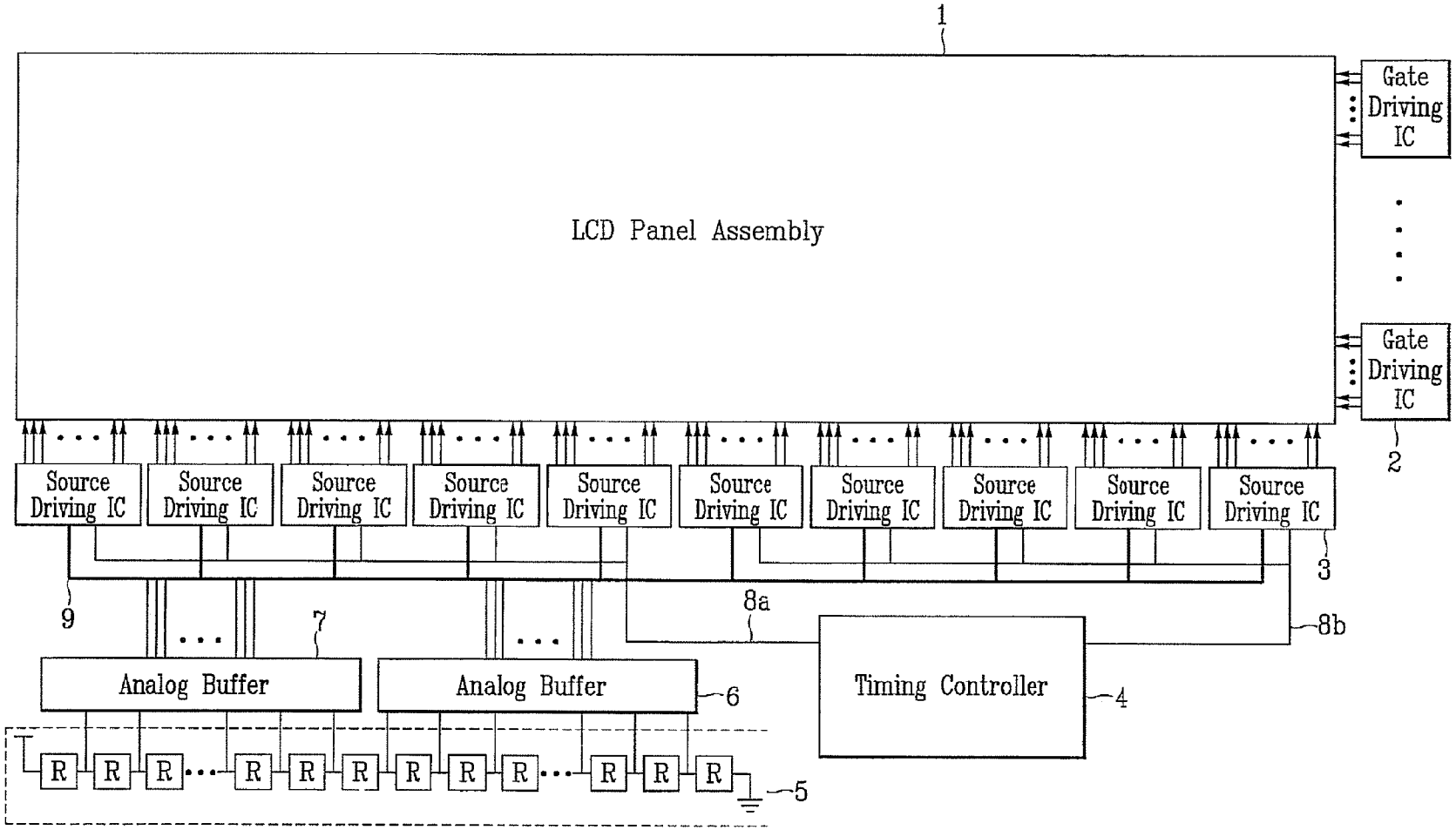
FIG. 1 shows a configuration of a conventional LCD.
Figure 2:
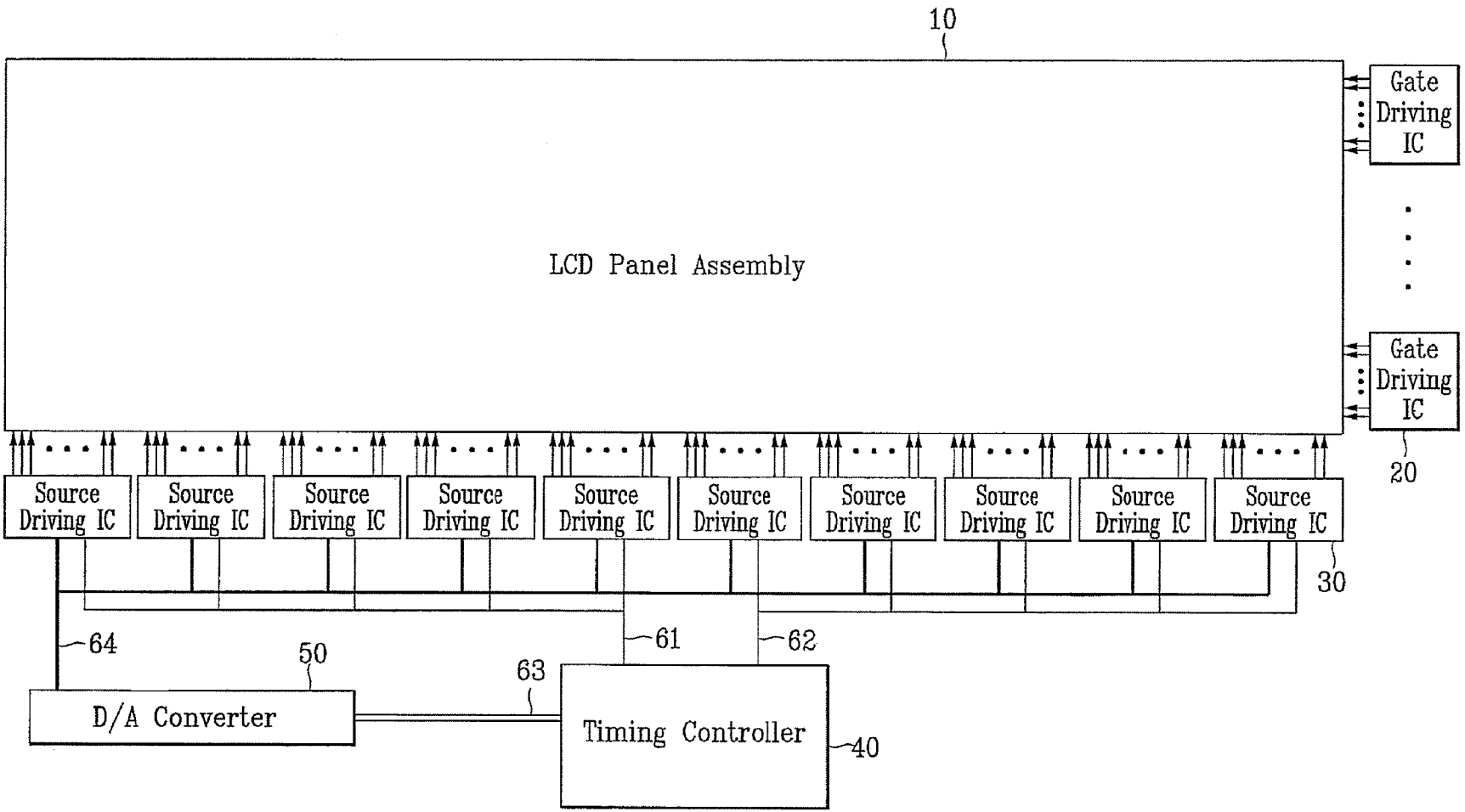
FIG. 2 illustrates a configuration of an LCD according to a first embodiment of the present invention.

FIG. 2 shows a configuration of an LCD according to a first embodiment of the present invention.

As shown in FIG. 2, an LCD according to a first embodiment of the present invention includes an LCD panel assembly 10 having a plurality of pixels provided at the crossing areas of a plurality of gate lines and a plurality of data lines, a plurality of gate driving ICs 20 applying voltage signals for sequentially scanning the gate lines, a plurality of source driving ICs 30 applying voltage signals for image display to the data lines, a timing controller 40 performing gate on/off control, providing data for image display (referred to as "image data" hereinafter) and control signals for the source driving ICs 30 and generating and outputting digital data for gamma voltages (referred to as "digital gamma data" hereinafter) to a digital-to-analogue ("D/A") converter 50, and the D/A converter 50 generating a plurality of gamma voltages by converting the digital gamma data into analog signals and supplying the gamma voltages to the source driving ICs 30.

Although not shown in FIG. 2, the LCD panel assembly 10 includes a plurality of gate lines extending in a transverse direction and a plurality of data lines crossing the gate lines such that the pixels are located at the cross areas.

The timing controller 40 sends the image data and the control signals to the source driving ICs 30 through signal lines 61 and 62. In addition, the timing controller 40 transmits the digital gamma data to the D/A converter 50 via a signal line 63 and transmits gate on/off control signals to the gate driving ICs 20 through other signal lines (not shown). The D/A converter 50 converts the digital gamma data from the timing controller 40 into analog signals to generate a plurality of the gamma voltages and provides the gamma voltages for the source driving ICs 30 through a signal line 64. The signal line 64 is configured such that the gamma voltages are commonly applied to the source driving ICs 30.

Once a power is applied to the LCD, the timing controller 40 generates the gate on/off control signals, the image data, the control signals, and the digital gamma data and outputs the signals to the gate driving ICs 20, the source driving ICs 30, and the D/A converter 50. The gate driving ICs 20 sequentially turn on the gate lines of the LCD panel assembly 10 such that the pixels connected to the gate lines are ready to display images. Each of the source driving ICs 30 selects one of the gamma voltages from the D/A converter 50 corresponding to each image data from the timing controller 40 and applies the selected gamma voltages to the corresponding pixels. The display of an image is actually enabled by these selected voltages applied to the pixels.

According to the present invention, the gamma voltages are generated by converting the digital gamma data from the timing controller 40 into analog signals by the D/A converter 50 in place of using serially-connected resistors. A conventional technique using the serially-connected resistors gives a characteristic curve of gamma voltages (referred to as "gamma curve" hereinafter) fixed by the resistances of the resistors. On the contrary, the gamma voltages according to the present invention may vary depending on the brightness of the image. For example, the gamma voltages are adjusted for obtaining high dynamic contrast such that the gamma curve is lowered for a dark image and is raised for a bright image. The D/A converter 50 according to the present invention generates the gamma voltages which are adjustable based on the brightness of the image.

Figure 3A:
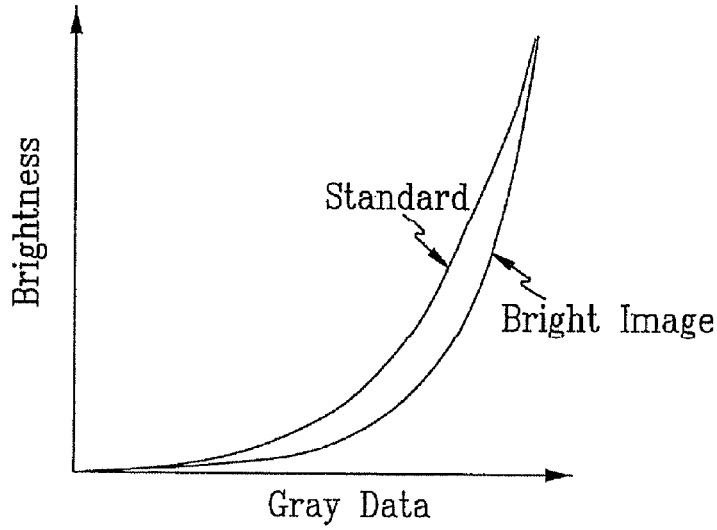
FIGS. 3A and 3B are graphs illustrating gamma voltages used for the LCD shown in FIG. 2.
Figure 3B:
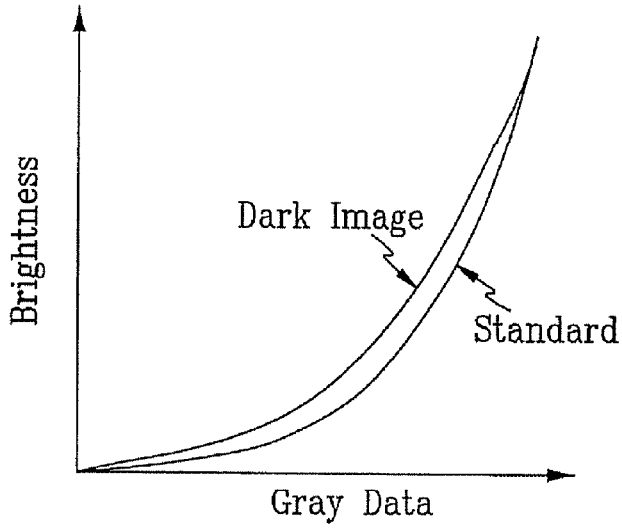

FIGS. 3A and 3B are graphs illustrating gamma curves used for the LCD shown in FIG. 2.

FIG. 3A illustrates a gamma curve for a bright image and FIG. 3B illustrates a gamma curve for a dark image. As shown in FIGS. 3A and 3B, an adjusted gamma curve for a bright image has larger gray data than gray data of a standard gamma curve, while an adjusted gamma curve for a dark image has smaller gray data than the gray data of the standard gamma curve. Accordingly, the dynamic contrast is improved by selecting an appropriate gamma curve depending on the brightness of the image.

The timing controller 40 generates digital gamma data based on the gamma curves. A method of generating gamma voltages according to an embodiment of the present invention will be described hereinafter with reference to FIG. 4.

Figure 4:
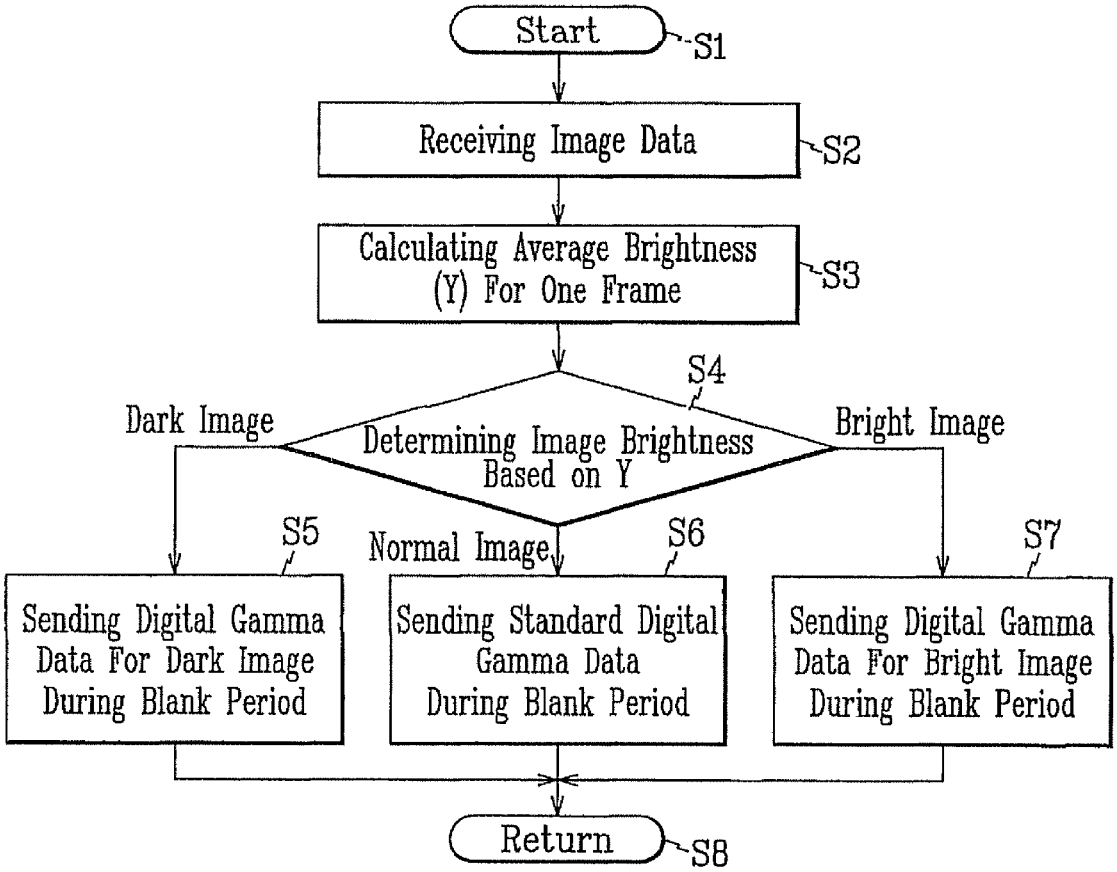
FIG. 4 is a flowchart illustrating a method of generating gamma voltages for an LCD according to the first embodiment of the present invention.

FIG. 4 is a flowchart illustrating a method of generating gamma voltages according to a first embodiment of the present invention. The flow chart shown in FIG. 4 illustrates the generation of digital gamma data by the timing controller 40 of the LCD.

Once a power is applied to the LCD (S1), image data for image display is inputted from an external graphic source (S2). The image data displays images and includes RGB data for red, green and blue colors.

An average brightness Y for one frame, which is a unit for an image, is calculated on the basis of the inputted RGB data (S3). The average brightness Y is given by following Equation 1:

$$Y=C_R\times R+C_G\times G+C_B\times B, \qquad \text{Equation 1}$$

where $C_R$, $C_G$ and $C_B$ are weights for red, green and blue colors, respectively, and R, G and B are averages of the image data for one frame for red, green, and blue colors, respectively.

Subsequently, the brightness of the image is determined by the calculated average brightness Y for selecting an appropriate gamma curve depending on the brightness of the image (S4).

As described above, an appropriate gamma curve is determined so that the selected gamma curve for a bright image has larger gray data than gray data of a standard gamma curve, while the selected gamma curve for a dark image has smaller gray data than the gray data of the standard gamma curve.

In order for the adjustment, it is required to determine whether the brightness for the image of the current frame is bright or dark, which can be determined by the calculated average brightness Y. For example, assuming that the average brightness ranges between 0 and 255, it is determined that the image of the current frame is dark if the average brightness Y is less than or equal to 64, while the image of the current frame is bright if the average brightness Y is greater than or equal to 192. Furthermore, if the average brightness Y is greater than 64 and less than 192, the current frame is determined to be a normal frame representing an image having a normal brightness.

The boundary values may be changed depending on the results of tests or experiments performed by a designer and the scope of the present invention is not limited by the boundary values used for determining the average brightness.

If it is determined that the image of the current frame is dark (S4), the timing controller 40 sends a set of digital gamma data suitable for the gamma curve for a dark image shown in FIG. 3B to the D/A converter 50 (S5). The transmission of the digital gamma data is performed during a blank period located between effective display periods.

Similarly, if the image of the current frame is determined to have normal brightness (S4), the timing controller 40 sends a set of digital gamma data suitable for the standard gamma curve shown in FIGS. 3A and 3B to the digital/analog converter 50 (S6). The digital gamma data is also sent during the blank period.

If it is determined that the image of the current frame is bright (S4), the timing controller 40 sends digital gamma data indicating the gamma curve for a bright image shown in FIG. 3A to the D/A converter 50 (S5). The digital gamma data is sent during the blank period.

The steps S2 to S7 are repeated frame by frame, and the completion of the step S7 makes the algorithm return for generating the gamma voltages for the image data of the next frame.

Thus, the gamma curve is determined depending on the average brightness Y obtained from the image data of the current frame, and a set of digital gamma data suitable for the gamma curve is transmitted during the blank period to be used for displaying the next frame. Although there exists a delay of one frame, it may be ignored because the average brightness Y is not abruptly changed between adjacent frames and the one-frame delay is not recognized by human eyes.

The data transmission from the timing controller 40 to the D/A converter 50 may be performed in series or in parallel. When the data transmission from the timing controller 40 to the D/A converter 50 is performed in series, the number of pins used in the ming controller 40 may be reduced.

An LCD according to a second embodiment of the present invention is described with reference to FIG. 5.

Figure 5:
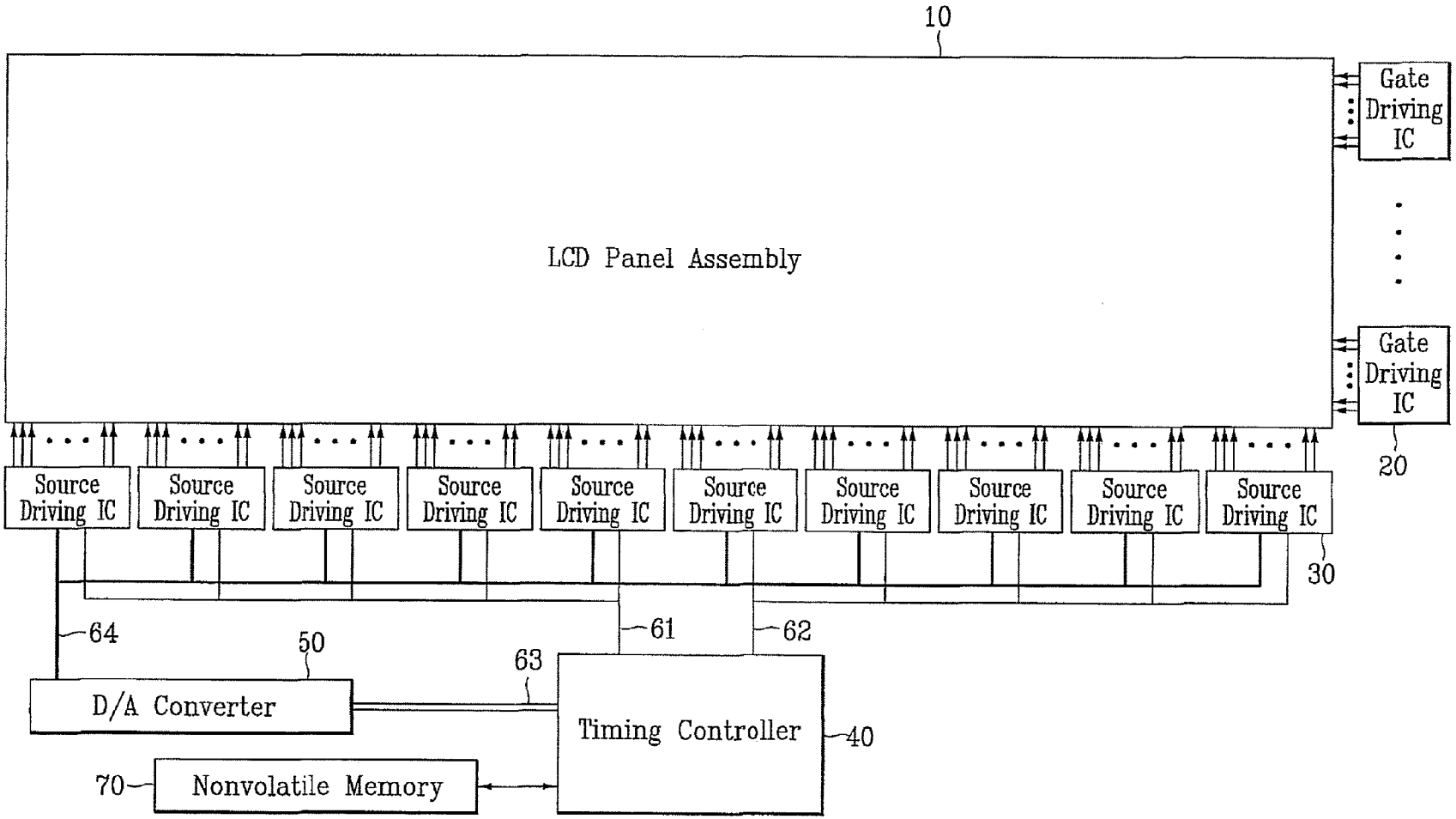
FIG. 5 illustrates a configuration of an LCD according to a second embodiment of the present invention.

As shown in FIG. 5, an LCD according to the second embodiment further includes a nonvolatile memory 70 compared with the LCD according to the first embodiment of the present invention.

The nonvolatile memory 70 stores information about the gamma curves for dark, normal, and bright images depending on the brightness of an image.

Once the LCD is operated, the information about the gamma curves is transmitted to an inner memory of the timing controller 40 from the nonvolatile memory 70. Thus, the LCD may easily update the information about the gamma curves.

As described above, in an LCD of the present invention, digital gamma data generated by a ming controller is converted into analog signals to generate gamma voltages such that the gamma voltages may be easily adjusted. Accordingly, the gamma voltages may be optimized to the brightness of an image, resulting in enhancement of the dynamic contrast of the LCD.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A liquid crystal display comprising:

a liquid crystal display panel assembly including a plurality of pixels provided on crossing areas of a plurality of gate lines and a plurality of data lines;

a gate driver applying voltage signals for sequentially scanning the gate lines;

a source driver applying voltage signals for image display to the data lines;

a timing controller providing image data and a control signal for the source driver, providing a gate line on/off control signal for the gate driver;

a digital/analogue (D/A) converter converting the digital gamma data from the timing controller into analog signals to generate a plurality of gamma voltages and outputting the gamma voltages to the source driver; and a storage connected to the timing controller for storing gamma data of the gamma curves for dark, normal, and bright images, wherein the timing controller receives the image data for red, green and blue colors, calculates an average brightness for one frame based on the image data for red, green and blue colors, compares the average brightness for the frame with a predetermined brightness range, selects one of gamma curves for dark, normal and bright images based on the comparison result, and outputs the digital gamma data to the D/A converter using information about the selected gamma curve, wherein the timing controller selects the gamma curve for bright image when the average brightness for the frame is greater than the predetermined brightness range, selects the gamma curve for dark image when the average brightness for the frame is less than the predetermined brightness range, and selects the gamma curve for the normal image when the average brightness for the frame is within the predetermined brightness range, and wherein the timing controller includes a memory storing digital information about gamma curves for dark, normal, and bright images, and wherein the storage transmitting the gamma data of the gamma curves for dark, normal, and bright images to the memory of the timing controller when a power is applied to the liquid crystal display.

2. The liquid crystal display of claim 1, wherein the average brightness is determined by:

$$Y=C_R\times R+C_G\times G+C_B\times B$$

where $C_R$, $C_G$ and $C_B$ are weights of the image data for red, green, and blue colors, respectively, R, G and B are averages of the image data for red, green and blue colors, respectively, for the one frame, and Y is the average brightness.

3. The liquid crystal display of claim 1, wherein the digital gamma data transmitted in series from the timing controller to the D/A converter.

4. The liquid crystal display of claim 1, wherein the digital gamma data transmitted in parallel from the timing controller to the D/A converter.

5. The liquid crystal display of claim 1, wherein the memory of the timing controller stores gamma of the gamma curves for dark, normal, and bright images.

6. The liquid crystal display of claim 1, wherein the D/A converter is connected to the timing controller via a digital interface.

7. The liquid crystal display of claim 1, wherein the gamma curve for bright image has gray data greater than gray data of the gamma curve for normal image, and the gamma curve for dark image has gray data less than the gray data of the gamma curve for normal image.

8. A method of generating a gamma voltage for a liquid crystal display, the method comprising:

receiving red, green, and blue data from a graphic source;

calculating an average brightness of the red, green, and blue data for a frame;

comparing the average brightness with a predetermined brightness range;

storing digital information about gamma curves for dark, normal, and bright images;

selecting one of gamma curves for dark, normal and bright images based on the comparison result:

generating and transmitting digital gamma data suitable for the brightness of the frame by using the digital information about the selected gamma curve; and converting the digital gamma data into an analog signal to generate a gamma voltage, wherein selecting one of the gamma curves comprises:

selecting the gamma curve for bright image when the average brightness for the frame is greater than the predetermined brightness range:

selecting the gamma curve for dark image when the average brightness for the frame is less than the predetermined brightness range: and selecting the gamma curve for the normal image when the average brightness for the frame is within the predetermined brightness range, and wherein transmitting digital gamma data is performed during a blank period.

9. The method of claim 8, wherein the transmission of the digital gamma data is performed via a digital interface.

10. The method of claim 9, wherein the transmission of the digital gamma data is performed in series.

11. The method of claim 9, wherein the transmission of the digital gamma data is performed in parallel.

12. The method of claim 9, wherein the gamma curve for bright image has gray data greater than gray data of the gamma curve for normal image, and the gamma curve for dark image has gray data less than the gray data of the gamma curve for normal image.

13. The method of claim 9, wherein the digital information about gamma curves for dark, normal, and bright images includes gamma data of the gamma curve for dark, normal, and bright images.

14. A method for generating a gamma voltage for a liquid crystal display, comprising:

receiving image data from a graphic source;

calculating an average brightness of the image data for a current frame based on the image data for red, green and blue colors;

determining whether a brightness of the current frame is dark, normal, or bright on the average brightness of the current frame;

storing digital information about gamma curves for dark, normal, and bright images;

selecting one of gamma curves for dark, normal, and bright images based on the determined brightness of the current frame; and generating a gamma voltage for the current frame using the digital information about the selected gamma curve, wherein selecting one of the gamma curves for dark, normal, and bright images comprises:

selecting the gamma curve for bright image when the average brightness of the current frame is greater than a predetermined brightness range;

selecting the gamma curve for dark image when the average brightness of the current frame is less than the predetermined brightness range; and selecting the gamma curve for the normal image when the average brightness of the current frame is within the predetermined brightness range, and wherein generating a gamma voltage for the current frame comprises generating digital gamma data by using the digital information about the selected gamma curve and transmitting the digital gamma data to generate the gamma voltage during a blank period between display periods.

15. The method of claim 14, further comprising displaying an image for a next frame using the gamma voltage.

16. The method of claim 14, wherein calculating the average brightness is performed by the following equation:

$$Y=C_R\times R+C_G\times G+C_B\times B$$

where Y is the average brightness, $C_R$, $C_G$ and $C_B$ are weights the image data for red, green, and blue colors, respectively, and R, G and B are averages of the image data for the red, the green and the blue colors, respectively, for the current frame.

17. The method of claim 14, wherein determining whether a brightness of the current frame is dark, normal, or bright comprises comparing the average brightness with a predetermined brightness ranges.

18. The method of claim 14, wherein the gamma curve for bright image has gray data greater than gray data of the gamma curve for normal image, and the gamma curve for dark image has gray data less than the gray data of the gamma curve for normal image.

19. The method of claim 14, wherein the digital information about gamma curves for dark, normal, and bright images includes gamma data of the gamma curve for dark, normal, and bright images.

20. A liquid crystal display comprising:

a liquid crystal display panel assembly including a plurality of pixels provided on crossing areas of a plurality of gate lines and a plurality of data lines;

a gate driver applying voltage signals for sequentially scanning the gate lines;

a source driver applying voltage signals for image display to the data lines;

a timing controller providing image data and a control signal for the source driver, providing a gate line on/off control signal for the gate driver; and a digital/analogue (D/A) converting the digital gamma data from the timing controller into analog signals to generate a plurality of gamma voltages and outputting the gamma voltages to the source driver, wherein the timing controller receives the image data for red, green and blue colors, calculates an average brightness for one frame based on the image data for red, green and blue colors, compares the average brightness for the frame with a predetermined brightness range, selects one of gamma curves for dark, normal and bright images based on the comparison result, and outputs the digital gamma data to the D/A converter based on the selected gamma curve, wherein the timing controller includes a memory storing digital information about gamma curves for dark, normal, and bright images, and wherein a storage connected to the timing controller and the memory of the timing controller stores gamma data of the gamma curves for dark, normal, and bright images from the storage when a power is applied to the liquid crystal display.

* * * * *